US008319598B2

(12) United States Patent
Zandman et al.

(10) Patent No.: US 8,319,598 B2
(45) Date of Patent: Nov. 27, 2012

(54) POWER RESISTOR

(75) Inventors: Felix Zandman, Malvern, PA (US); Clark L. Smith, Columbus, NE (US); Todd L. Wyatt, Columbus, NE (US); Thomas L. Veik, Columbus, NE (US); Thomas L. Bertsch, Norfolk, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 0 days.

(21) Appl. No.: 12/950,177

(22) Filed: Nov. 19, 2010

(65) Prior Publication Data

US 2011/0063071 A1 Mar. 17, 2011

Related U.S. Application Data

(62) Division of application No. 11/862,572, filed on Sep. 27, 2007, now Pat. No. 7,843,309.

(51) Int. Cl.
*H01C 10/00* (2006.01)

(52) U.S. Cl. ..... 338/195; 338/325; 338/332

(58) Field of Classification Search ..... 338/195, 338/48, 51, 260, 283, 293, 307, 309, 325, 338/332

See application file for complete search history.

(56) References Cited

U.S. PATENT DOCUMENTS

| | | | | |
|---|---|---|---|---|
| 5,252,944 | A | 10/1993 | Caddock, Jr. | |
| 5,287,083 | A | 2/1994 | Person et al. | |
| 5,291,178 | A | 3/1994 | Strief et al. | |
| 5,304,977 | A | 4/1994 | Caddock, Jr. | |
| 5,481,241 | A | 1/1996 | Caddock, Jr. | |
| 5,604,477 | A | 2/1997 | Rainer et al. | |
| 5,621,240 | A | 4/1997 | Ellis | |
| 5,621,378 | A | 4/1997 | Caddock, Jr. et al. | |
| 6,084,502 | A * | 7/2000 | Ariga et al. | 338/195 |
| 6,144,287 | A * | 11/2000 | Komeda | 338/195 |
| 6,148,502 | A | 11/2000 | Gerber et al. | |
| 6,480,092 | B1 * | 11/2002 | Hoshii et al. | 338/195 |
| 7,190,252 | B2 | 3/2007 | Smith et al. | |
| 2004/0233032 | A1 * | 11/2004 | Schneekloth et al. | 338/7 |

FOREIGN PATENT DOCUMENTS

| | | | |
|---|---|---|---|
| DE | 39 33 956 | A1 | 4/1991 |
| EP | 0 637 826 | A1 | 2/1995 |
| EP | 1 628 331 | A1 | 2/2006 |
| JP | 2-312203 | A | 12/1990 |
| JP | 11-186010 | A | 1/1999 |

OTHER PUBLICATIONS

TT Electronics, IRC Advanced Film Division, "MHP TO-220 Series Power Resistor" data sheets, Sep. 2006 (3 pages).

(Continued)

*Primary Examiner* — Kyung Lee
(74) *Attorney, Agent, or Firm* — Volpe and Koenig, P.C.

(57) ABSTRACT

A power resistor includes first and second opposite terminations, a resistive element formed from a plurality of resistive element segments between the first and second opposite terminations, at least one segmenting conductive strip separating two of the resistive element segments, and at least one open area between the first and second opposite terminations and separating at least two resistive element segments. Separation of the plurality of resistive element segments assists in spreading heat throughout the power resistor. The power resistor or other electronic component may be packaged by bonding to a heat sink tab with a thermally conductive and electrically insulative material.

13 Claims, 10 Drawing Sheets

OTHER PUBLICATIONS

TT Electronics, BI Technologies, SMHP 20, "20W TO-263 High Power Surface Mount Resistors" data sheets (4 pages) www.bitechnologies.com.

TT Electronics, BI Technologies, MHP 100 "100W TO-247 High Power Resistors" data sheets (2 pages) www.bitechnologies.com.

TT Electronics, BI Technologies, MHP 140 "140W TO-247 High Power Resistors" data sheets (2 pages) www.bitechnologies.com.

Caddock Electronics, Inc., "MP900 and MP9000 Series Kool-Pak Power Film Resistors TO-126, TO-220 and TO-247 Style" data sheets, 2004 (2 pages).

Caddock Electronics, Inc., "MP2060 Kool-Pak Clip Mount Power Film Resistor," data sheet, 2004 (1 page).

Caddock Electronics, Inc., "MP800 Series Kool-Pak Power Film Resistors TO-220 Style and TO-126 Style-Non-Inductive Designs," data sheets, 2004 (2 pages).

Caddock Electronics, Inc., "MP725 Surface Mount Power Film Resistors," data sheet, 2004 (1 page).

Vishay Techno, TPR "Thick Film Technology Power Resistors 20 Watt and 30 Watt TO-220 Package," data sheet document No. 68018, Dec. 5, 2005 (3 pages).

Vishay Sfernice, RTO 20, "Power Resistors Thick Film Technology," data sheet document No. 50005, Nov. 22, 2006 (4 pages).

Vishay Sfernice, RTO 50, "Power Resistor, Thick Film Technology," data sheet document No. 50035, May 30, 2006 (4 pages).

Bourns, "PWR220 F Series Power Resistor" data sheet, Jan. 27, 2003 (3 pages).

Bourns, "PWR220 S Series Shunt Resistor" data sheet, Jan. 27, 2003 (4 pages).

* cited by examiner

POWER RESISTOR

CROSS REFERENCE TO RELATED APPLICATION

This application is a division of U.S. patent application Ser. No. 11/862,572, filed Sep. 27, 2007, which is incorporated by reference as if fully set forth herein.

BACKGROUND

The present invention relates generally to a power resistor with a free standing element. A free standing resistor has a resistor element formed of a material having sufficient thickness to be self supporting without the aid of a substrate. More particularly, but not exclusively, the present invention relates to maximizing the wattage rating of a power resistor. In addition, the present invention relates to spreading heat across the resistive element of a resistor to thereby improve performance.

In addition, the present invention relates to maximizing the wattage rating of a power resistor while minimizing the physical dimensions of the resistor. This challenge has been addressed for film resistor technologies where the resistive element is on a ceramic substrate that can be bonded to the metal tab of a power IC package without electrically shorting the resistive element to the metal tab. Such an approach does not address the metal strip type resistor that does not have an electrically insulative substrate that can go between the resistive element and the metal heat sink tab of the IC package providing electrical isolation of one from the other.

Not having a solution to this problem has denied the electronics industry the benefits of a metal strip resistor's ultra low ohmic values, pulse power handling, low TCR, low thermal EMF, load life stability and low TCR in a high power density IC type package.

SUMMARY

According to one aspect of the present invention, a power resistor is provided. The power resistor includes first and second opposite terminations and a resistive element formed from a plurality of resistive element segments between the first and second opposite terminations. There is at least one segmenting conductive strip separating two of the resistive element segments and there is at least one open area between the first and second opposite terminations and separating at least two resistive element segments. The separation of the resistive element segments assists in spreading heat throughout the power resistor. According to another aspect of the present invention, the power resistor or other electronic component may be packaged by bonding the power resistor or other electronic element to a heat sink tab with a thermally conductive and electrically insulative material to thereby mechanically connect the heat sink tab and the electronic element in a heat conducting relation without short circuiting the heat sink tab to the electronic element. The power resistor or other electronic element may be packaged by connecting terminals and forming a molded body to encase the resulting device.

A method of manufacturing a power resistor includes forming a joined metal strip providing first and second opposite terminations and a resistive element between the first and second opposite terminations wherein the first termination is formed from a first outer metal strip, the resistive element is formed from a middle strip, and the second opposite termination is formed from a second opposite outer metal strip, the three strips joined together to from the joined metal strip.

Then the method provides for segmenting the resistive element into a plurality of resistive element segments between the first and second opposite terminations by providing at least one segmenting conductive strip separating two of the resistive element segments and at least one open area between the first and second opposite terminations and separating at least two resistive element segments. The separation of the plurality of resistive element segments assists in spreading heat throughout the power resistor.

A method of forming an electronic component includes providing an electronic element, bonding the electronic element to a heat sink tab, the electronic element bonded to the heat sink tab with a thermally conductive and electrically insulative material to thereby mechanically connect the heat sink tab and the resistive element without short circuiting the heat sink tab to the resistive element, connecting at least two terminals to the electronic element, and encasing the electronic element within a molded body.

According to another aspect, a power resistor includes first and second opposite terminations and a resistive element between the first and second opposite terminations, the resistive element having a plurality of separated resistive element segments. The first and second opposite terminations and the resistive element are formed from adjoining strips of conductive material and resistive material in a free standing metal strip resistor configuration. The separated resistive element segments may be separated by one or more conductive strips or one or more open areas creating more than one hot spot to spread the heat. Each of the resistive element segments may have its own trimming pattern to manipulate current flow and create more than one hot spot in each segment.

According to yet another aspect, a power resistor includes first and second opposite terminations and a resistive element between the first and second opposite terminations, the resistive element having a trimming pattern. The first and second opposite terminations and the resistive element are formed from adjoining strips of conductive material and resistive material in a free standing resistor configuration. The trimming pattern includes at least one slot terminating in a hole.

DETAILED DESCRIPTION OF THE PREFERRED EMBODIMENTS

Figure 1:
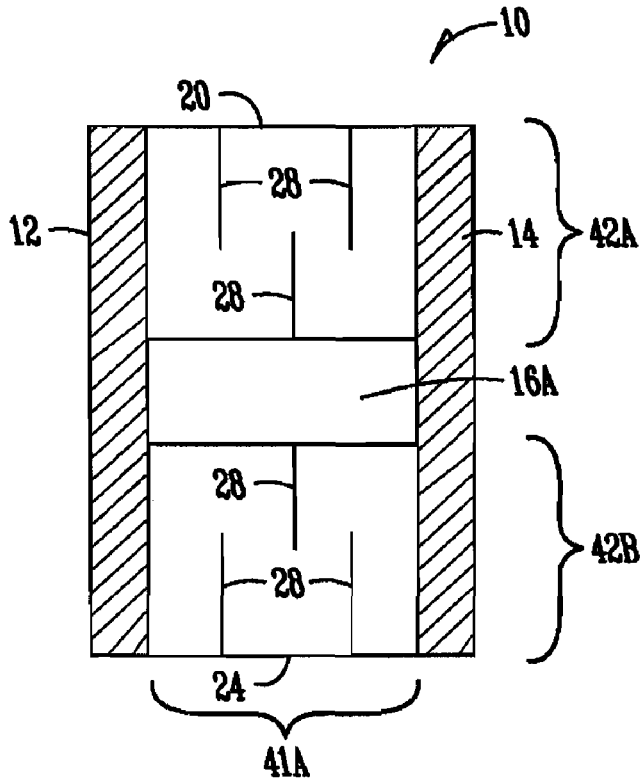
FIG. 1 illustrates one embodiment of a free standing resistor having two segments separated by an open space.
Figure 2:
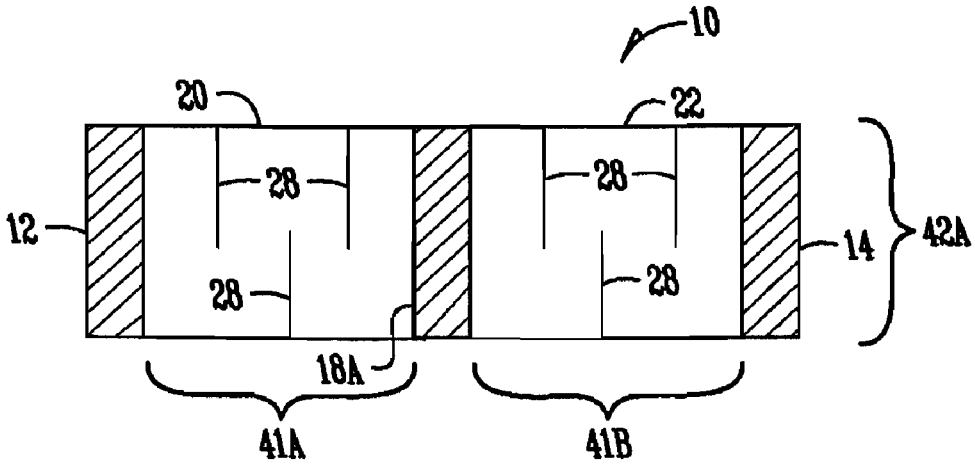
FIG. 2 illustrates one embodiment of a free standing resistor having two segments separated by a segmenting conductive strip.
Figure 3:
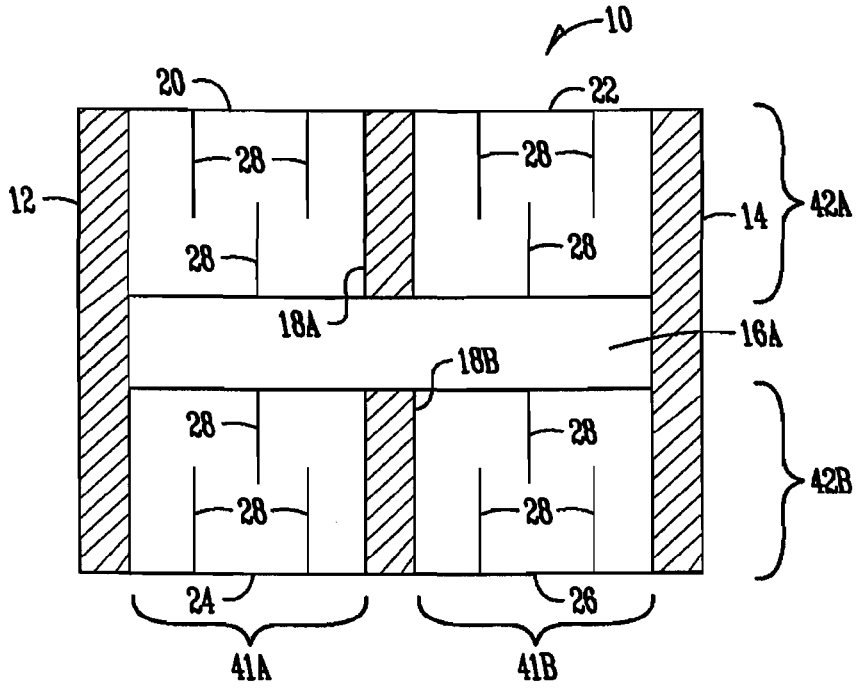
FIG. 3 illustrates one embodiment of a free standing resistor having four segments and formed using a metal strip.

FIG. 3 illustrates one embodiment of a free standing resistor 10 formed of a metal strip which is segmented. The resistor 10 has a first conductive strip 12 and an opposite second conductive strip 14 to form opposite terminals for the resistor 10. An open area 16A is shown between the first conductive strip 12 and the opposite second conductive strip 14. Segmenting conductive strips 18A, 18B are also shown. The open area 16A and the segmenting conductive strips 18A, 18B serve to segment the resistive element of the resistor 10 into four segments 20, 22, 24, 26. Within each of the four segments 20, 22, 24, 26, slots 28 are cut to adjust resistivity and form a serpentine current path.

The configuration shown in FIG. 3 provides significant advantages. In particular, the segmentation forces the heat to be spread out over a larger portion of the resistive element thus reducing the peak temperature in any one spot. In particular, compared to an unsegmented resistive element without the segmenting conductive strips 18A, 18B and without the open area, the heat is spread out more due to the routing of current into areas of the resistor 10 normally underutilized. This routing is performed by use of resistive element segments 20, 22, 24, 26. The segmentation and routing requires that power is dissipated equally in all segments.

Where the resistive element segments are of the same size, the resistive element segments may be considered to form rows and columns, such as rows 42A, 42B and columns 41A, 41B shown in FIG. 3. In the embodiment shown in FIG. 3, there are a total of four segments, organized in two columns and two rows formed by the open area 16A which isolates a first row 42A from a second row 42B. The segmenting conductive strips 18A, 18B separate the resistive element segments into separate columns.

It should be appreciated that the particular configuration shown in FIG. 3 is merely one of numerous embodiments where segmenting conductive strips and open areas are used to segment a resistive element to reduce peak temperature in any one spot. Variations are contemplated in the overall number of segments, the relative sizes of segments, the relative alignments of segments, and the geometries of the segments. Variations are also contemplated in the trimming geometries, angles, and positions, used to manipulate current flow and increase the number of hot spots. The hot spots are regions of the resistor having measurably hotter temperatures than other regions of the resistor.

Figure 4:
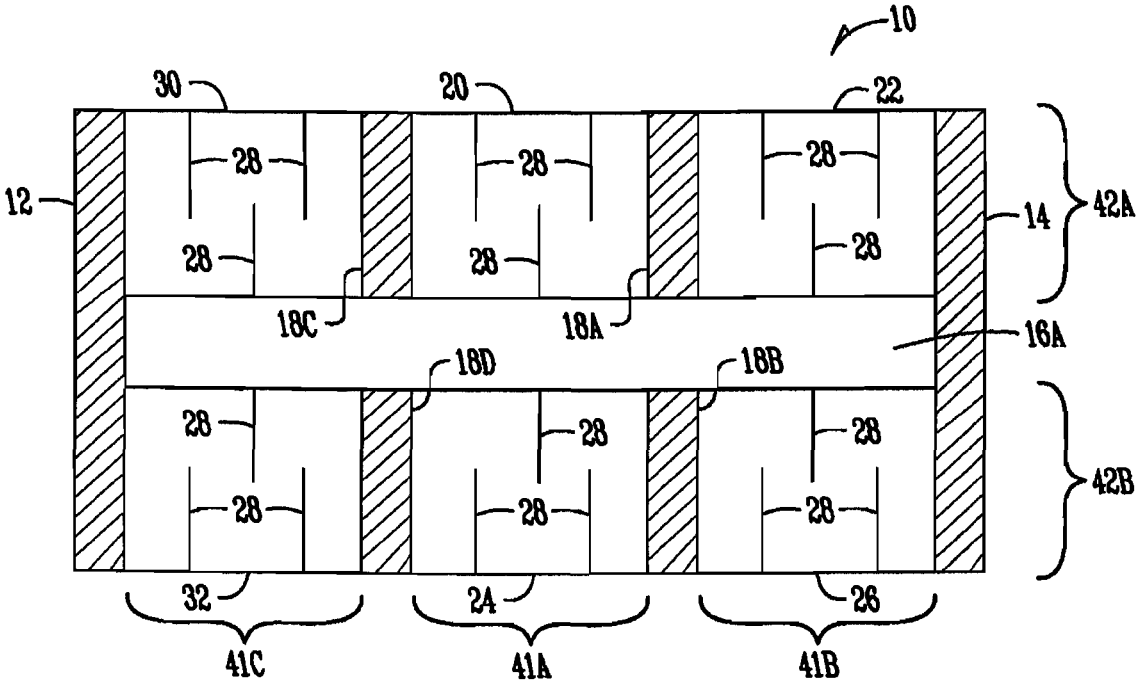
FIG. 4 illustrates one embodiment of a free standing resistor having six segments and formed using a metal strip.

FIG. 4 is an example of another embodiment where six resistive element segments 20, 22, 24, 26, 30, 32 are shown, organized into two rows 42A, 42B and three columns 41A, 41B, 41C. The embodiment of FIG. 4 includes segmenting conductive strips 18A, 18B 18C, 18D to further segment the resistive element.

Figure 5:
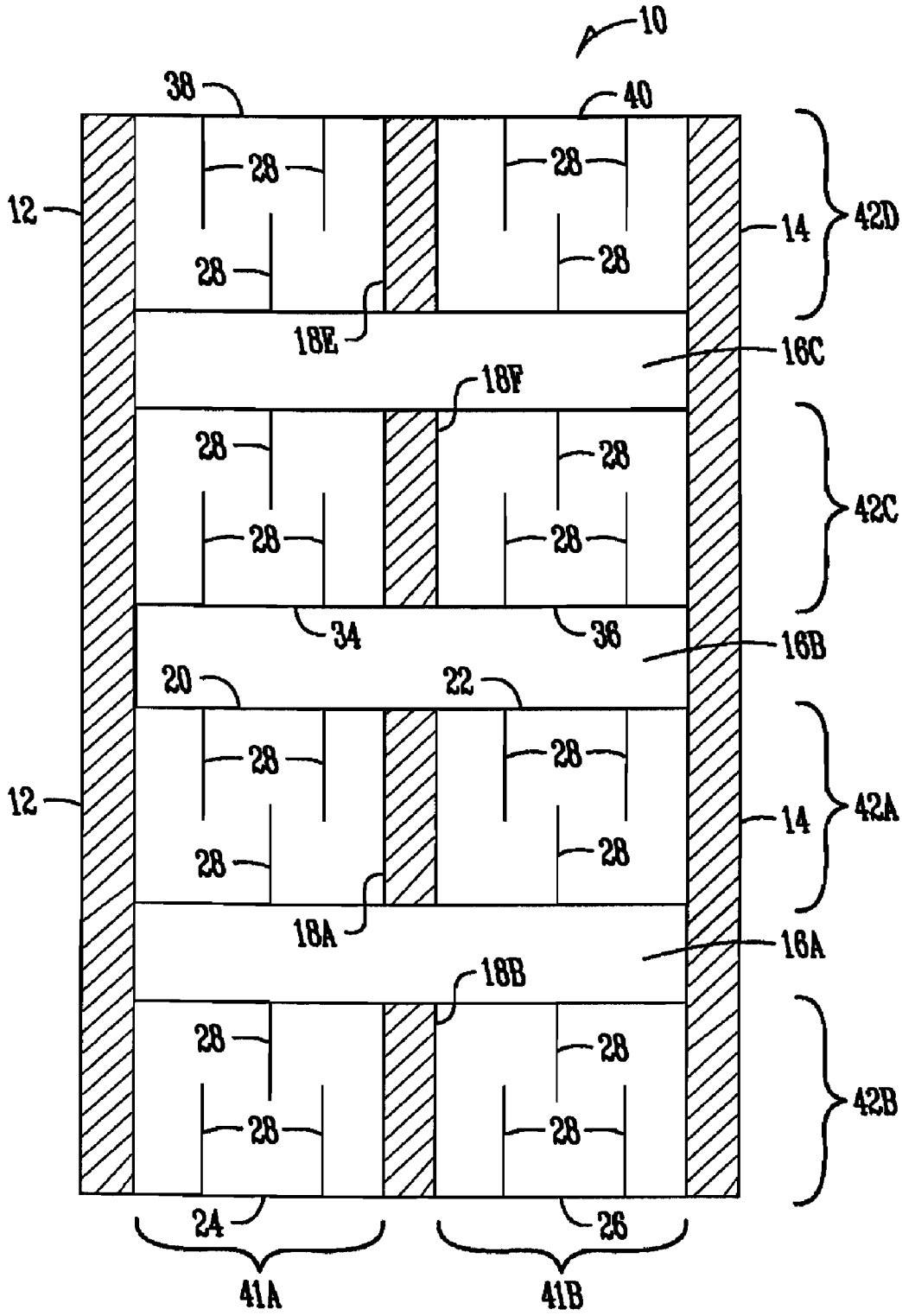
FIG. 5 illustrates one embodiment of a free standing resistor having eight segments and formed using a metal strip.

FIG. 5 is an example of another embodiment where eight resistive element segments 20, 22, 24, 26, 34, 36, 38, 40 are shown, organized into to columns 41A, 41B and four rows 42A, 42B, 42C, 42D. In the embodiment shown in FIG. 5, there are three open areas 16A, 16B, 16C which provide for segmenting the resistive element. In addition, co-linear segmenting conductive strips 18A, 18B, 18E, 18F are shown.

In the embodiments shown, some level of symmetry with respect to the definition of the resistive element segments is maintained in that the sizes of the resistive elements are maintained with respect to one another which supports ease of manufacture and design and assists in explanation, however such symmetry need not always be present, depending on the desired characteristics of the resulting resistor. However, the creation of multiple distinct hot spots by segmenting the resistive element forces the heat to be spread out over a larger portion of the element thus reducing the peak temperature in any one spot.

Figure 6:
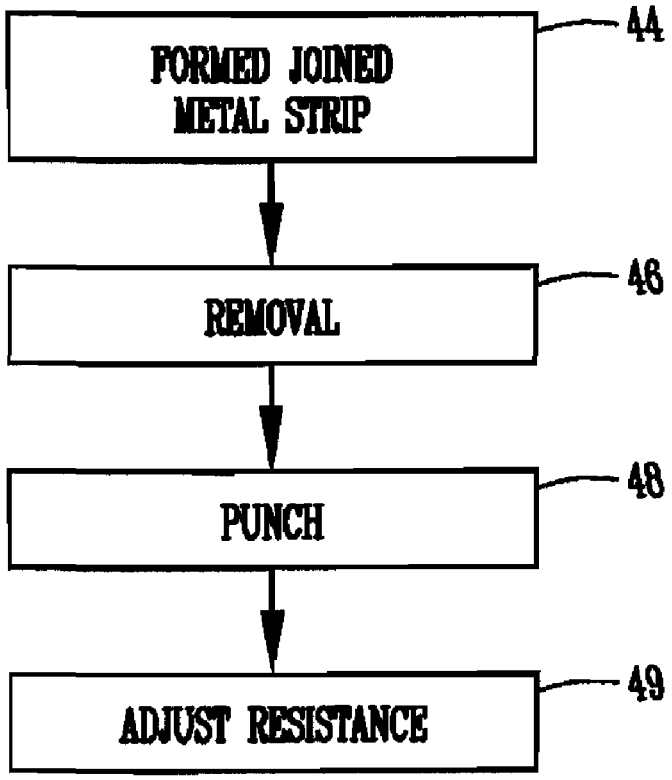
FIG. 6 illustrates one embodiment of a methodology for forming a free standing resistor formed using a metal strip.

FIG. 6 illustrates one embodiment of a methodology for manufacturing a metal strip power resistor according to the present invention. EVANOHM precision resistance alloy, or other type of resistive element, such as but not limited to alloys containing Nickel and Chromium may be used to form the resistive alloy. The resistance alloy may be copper clad through rolling with the resulting bi-metal material wound upon a reel. Step 44 provides for forming the joined metals strips. Step 46 provides for removal of the copper or other material. The removal may be performed by etching, grinding, skiving, or other removal processes. Etching may be performed by chemical or electrochemical means to remove the copper cladding from the resistive element segments while leaving the copper cladding where appropriate to form the segmenting conductive strips. Punching may then be performed as shown in step 48 to form the open areas and also to singulate individual resistors. In step 49, resistance of each resistive element segment may be altered or adjusted through cutting slots. The methodology used allows for reel-to-reel manufacturing of the power resistors.

Another aspect of the present invention relates to packaging, more particularly to a power resistor in power IC package that has an integral heat sink molded into the package, or alternatively a thin coating used to encapsulate the resistor assembly while leaving the heat sink exposed. The metal strip resistor is described, in the context of a resistive element that need not be segmented, however, it is to be appreciated that the resistive element may be segmented as described above, in order to spread heat throughout the power resistor. The power IC package includes a die or element which may be any of the resistors disclosed, including those in FIG. 1-5 as well as other configurations of resistors.

Figure 7:
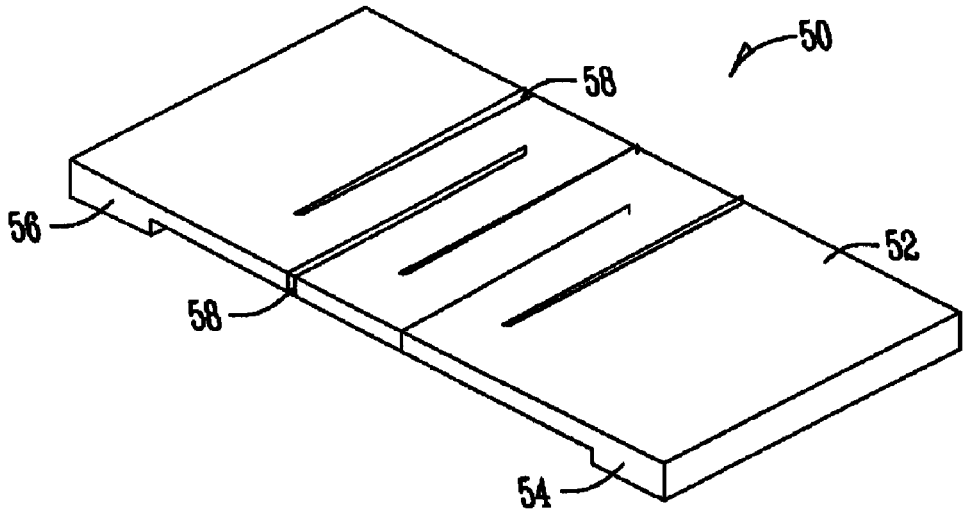
FIG. 7 is a perspective view illustrating a resistive element used in one embodiment of the present invention.

The packaging may be used in accordance with the segmented resistive elements previously described or other types of resistive elements, including those described in U.S. Pat. No. 5,604,477 to Rainer, herein incorporated by reference in its entirety. In such an embodiment, a surface mount resistor is formed by joining three strips of material together in edgeto-edge relation, with the center strip formed from an electrically resistive material and the end tips forming termination areas. Such resistors are offered under the trade name WSL by Vishay Dale Electronics, Inc. FIG. 7 illustrates one embodiment of such a packaging in the context of the present invention. In FIG. 7, the resistor 50 has a resistive element 52 formed by a center strip and opposite terminals 54, 56, formed by conductive strips. Slots 58 are cut in the resistive element 52 to adjust resistance.

Figure 8:
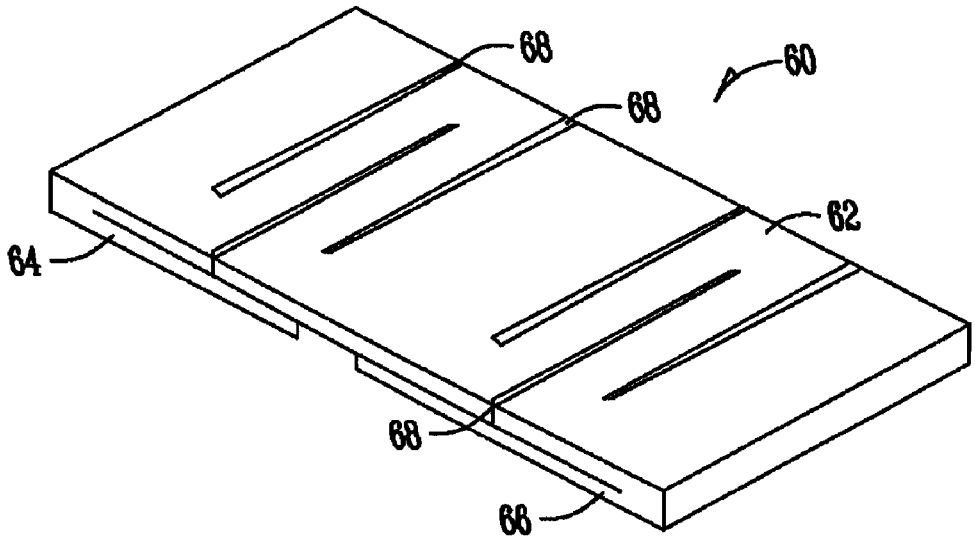
FIG. 8 is a perspective view illustrating another resistive element used in one embodiment of the present invention.

Another type of resistive element is described in U.S. Pat. No. 7,190,252 to Smith et al. In such an embodiment, a resistor has terminations folded under the resistive element with a thermally conductive and electrically insulated filler being sandwiched and bonded between the resistive element and the terminations. Such resistors are offered under the trade name WSH by Vishay Dale Electronics, Inc. Such a configuration has the added benefit of large terminations on the non-tab side of the resistor which serve to further spread the heat and reduce the hot spot temperature. FIG. 8 illustrates one embodiment of such a packaging in the context of the present invention. In FIG. 8, the resistor 60 has a resistive element 62 with terminations 64, 66 folded under the resistive element 62. Slots 68 are shown cut into the resistive element 62.

Figure 13:
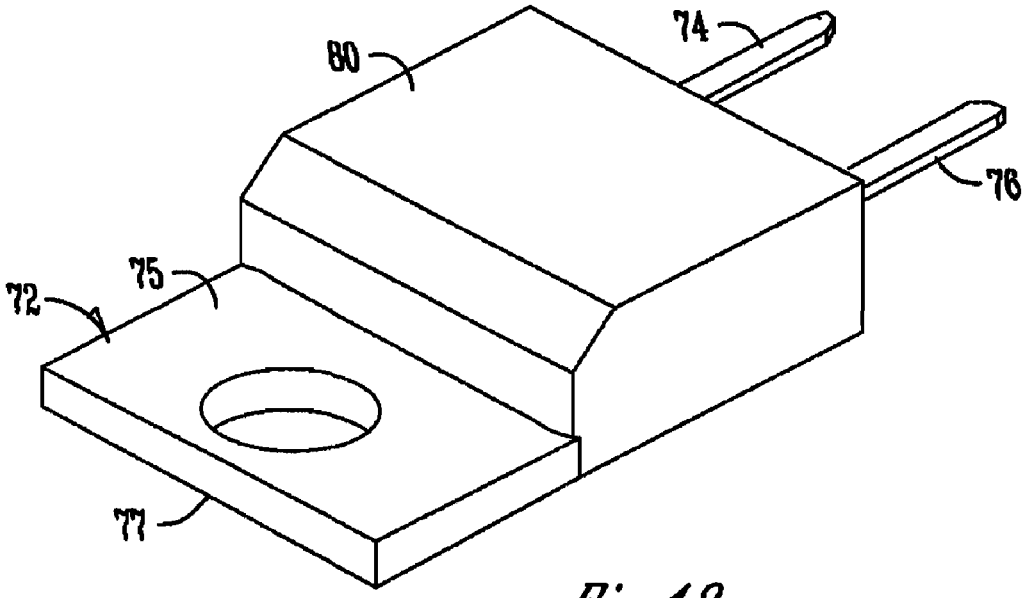
FIG. 13 is a perspective view illustrating an electronic component of the present invention having two terminals.

The resistors of FIGS. 7 and 8 may be used in standardized component packages. Standardized component packages are utilized in the electronics industry to minimize variation from supplier to supplier and to minimize the number of different package designs at the PCB design stage. Examples of these are TO-126, TO-220, TO-247, TO-263 and others. The component shown in FIG. 13 has a TO-220 package. A power IC package consists of a heat sink tab, terminals or leads, and a molded body. Internal to this package there is a die or element that defines the electrical characteristics of the component be it active or passive. The resistors of FIG. 1-5, FIG. 7-8 are examples of such elements. Also internal to the package are electrical connections between the element and the terminals and a thermal connection between the element and the heat sink tab.

Figure 9:
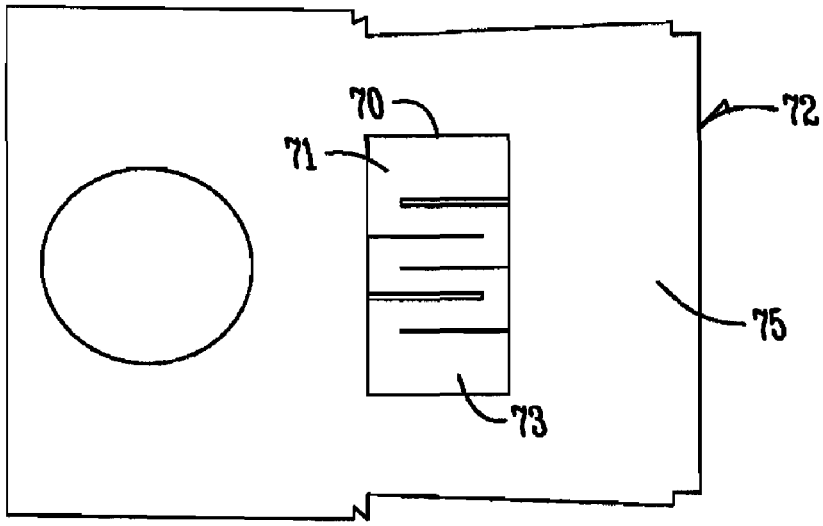
FIG. 9 is a top view illustrating a resistive element bonded to a heat sink tab according to one embodiment of the present invention.

In FIG. 9 a heat sink tab 72 is shown. The element 70, which may be a resistive element as previously described is bonded to a first side 75 of the heat sink tab 72. The element 70 has termination areas 71, 73. The bonding may be performed by applying an adhesion promoter like Dow Corning Sylgard to both the heat sink tab 72 and the element 70. Then a thermally conductive yet electrically insulative material is applied to the heat sink tab 72. This material is a paste or liquid and is composed of a elastomeric material (Dow Corning Q1-4010) that is filled with solid particles that conduct heat but are electrically insulative like boron nitride powder (COMBAT Boron Nitride Industrial Powders—Grade PHPP325) and alumina ceramic spheres. The alumina spheres have a diameter of 0.001" to 0.005" and have the primary purpose of spacing the resistive element and heat sink tab so they will not touch thus preventing an electrical short circuit between the two. The spheres are also small enough to minimize the distance between the element 70 and the heat sink tab 72 to optimize the heat transfer rate from the element 70 to the tab 72. In addition to the materials described, the present invention contemplates other materials with different compositions may be substituted provided they achieve the same objectives of maximizing heat transfer and creating an electrically non-conductive bond between the element 70 and the heat sink tab 72. During bonding, the element 70 and the tab 72 are pressed together and then heated while under pressure to insure they are in the optimum heat transfer relationship when bonded together. Utilizing these materials and bonding technique would also apply to bonding other types of elements including a foil element to a heat sink tab 72. This also enables a film or foil type element on ceramic to be bonded film or foil side towards the heat sink tab giving the benefit of the thermally coupling the heat generating element directly to the heat sink tab and utilizing the substrate as a heat spreader on the non-heat sink side. This bonding orientation reduces the heat transfer path length versus the trip through the ceramic then into the heat sink tab 72. In either case a chip resistor type element would be desirable since the wrap around terminations should attach the terminals away from the heat sink tab to avoid an electrical short circuit.

Figure 10:
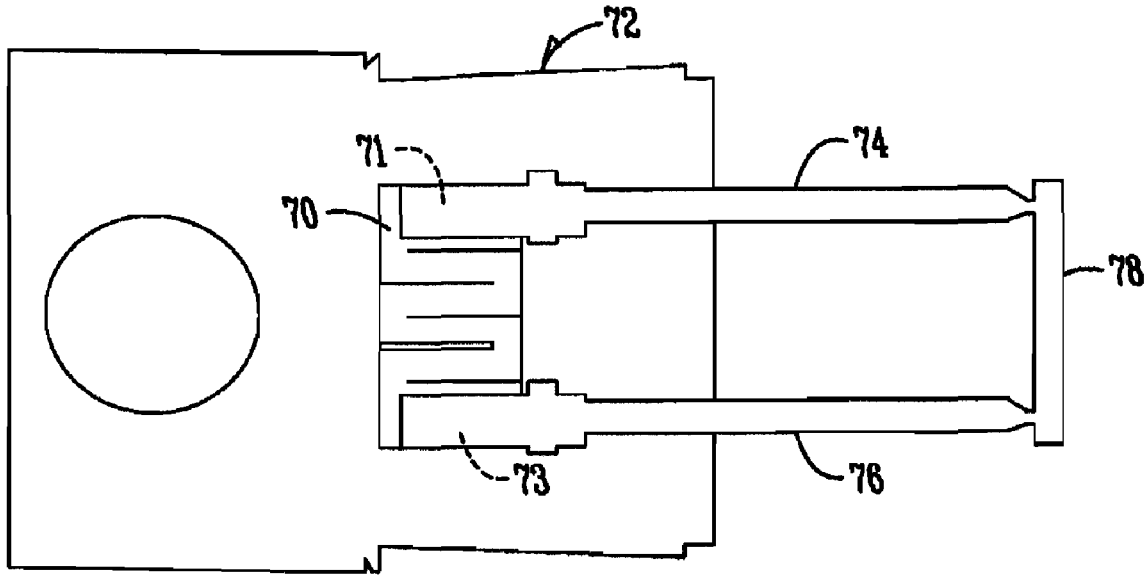
FIG. 10 is a top view illustrating a resistive element bonded to a heat sink tab with terminals connected according to one embodiment of the present invention.

Next, as shown in FIG. 10, terminals 74, 76 are soldered to the resistive element 70. The terminals 74, 76 are made of a conductive material such as a copper alloy and come connected to each other by a carrier strip 78 that sets the terminal spacing. The carrier strip 78 is later removed and discarded. The terminals 74, 76 are aligned to the terminations on the resistive element 70. Solder paste is applied to the terminals 74, 76 and resistive element 70 termination areas 71, 73 then heated to reflow the solder to join the terminals 74, 76 to the resistive element mechanically and electrically. The entire step of attaching terminals may be eliminated by having the terminals as a unitary part of the element terminations. Terminals can be punched from the copper termination material that is already welded to the resistive material. Such an alternative would increase usage of the welded strip material thus adding material cost. The alternative method described reduces manufacturing steps and eliminates solder. This allows the operating temperature of the device to be increased above solder reflow temperature and increases the reliability of the device by eliminating the internal solder joints. The steps of mounting the element 70 to the tab 72 and the terminals 74, 76 to the element 70 can be reversed without impacting the performance of the device.

Figure 11:
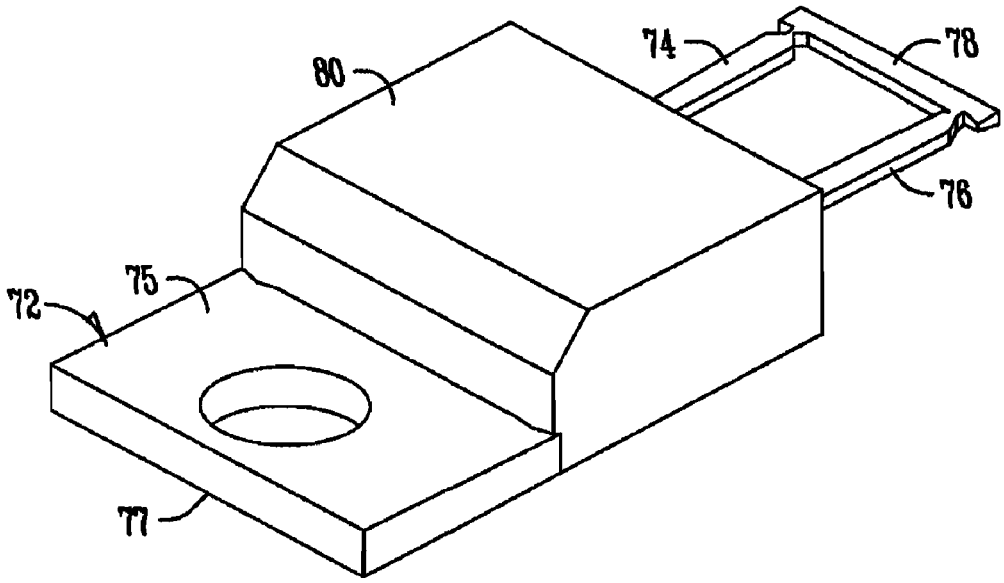
FIG. 11 is a perspective view illustrating an electronic component according to one embodiment of the present invention after molding and prior to the carrier strip being removed.
Figure 12:
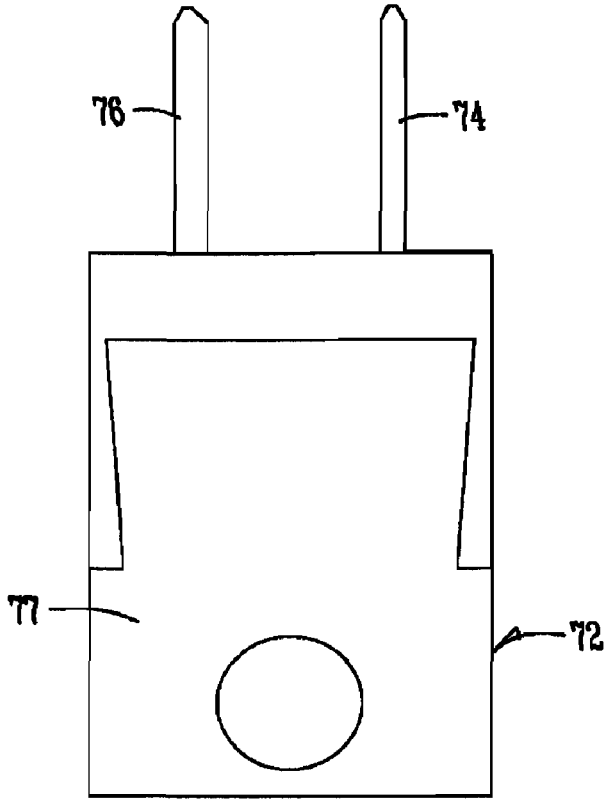
FIG. 12 is a bottom view illustrating an electronic component according to one embodiment of the present invention.

A protective coating (not shown) is then applied to the element 70 and terminal assembly to cover the portion that will be overmolded. This coating is to buffer the element 70 from the stresses caused by mold compound adhesion to the element. This sub-assembly is then put into a mold cavity which is subsequently filled with an epoxy molding compound. The mold cavity is constructed such that the non-element side of the heat sink tab 77 (see FIG. 12) is in contact with the mold cavity causing it to be not overmolded and thusly exposed on the back side of the molded body. FIG. 11 illustrates the molded body 80. This provides a mating surface for mounting to an external heat sink or chassis for heat transfer purposes.

Another option to overmolding is to coat the element side (side 75) of the sub-assembly with a conformal coating still leaving the non-element side (opposite side 77) of the heat sink tab 72 exposed for mating with an external heat sink. This implementation of the invention would yield a lower manufacturing cost at the expense of mechanical strength. After the molding operation there is a deflash operation to remove any excess mold compound from the edges of the body 80, terminals 74, 76 and heat sink tab 72.

Each resulting component may then be marked by a laser or ink marker with information pertinent to the product type. The carrier strip 78 is removed by a shearing operation, resulting in the component shown in FIG. 13. Where the component is a resistor, each resistor is tested for resistance then placed in the required packaging material for shipment.

Figure 14:
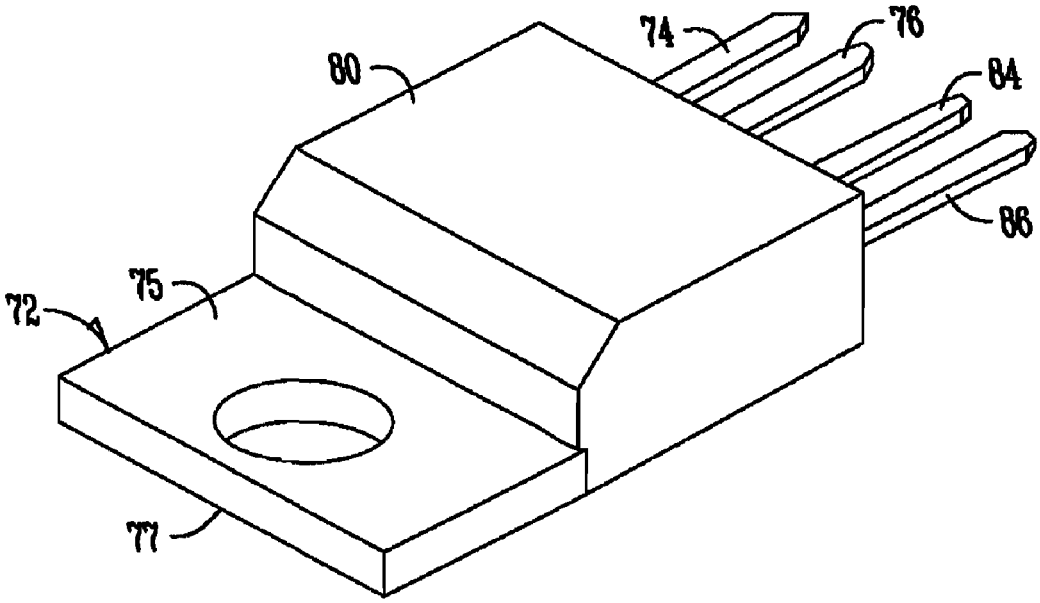
FIG. 14 is a perspective view illustrating an electronic component of the present invention having four terminals.

It should also be appreciated the described embodiment uses two terminals. However, as shown in FIG. 14, four terminals 74, 76, 84, 86 may be used, such as when Kelvin measurement connections are needed in applications where the best TCR and resistance tolerance are required.

It should be appreciated that this type of packaging may be used not only with the power resistors shown but with other type of electronic components that do not necessarily include a resistive element as part of an electronic element. The packaging described is useful where an integral heat sink molded into the package is needed. Although, as earlier explained the molding could be eliminated and a thin coating used to encapsulate the resistor assembly while leaving the heat sink exposed.

It is further observed that the packaging allow a metal strip resistor to be used rather than a film type resistor. This is significant because film resistors employ a ceramic substrate to provide mechanical support to the film layers. This substrate is electrically insulative and is also used to electrically isolate the film element from the metal heat sink tab of the IC package when the two are bonded together for heat transfer purposes.

The metal strip resistor has no ceramic substrate and gets its mechanical strength from the fact that it is a relatively thick piece of metal. The problem then becomes how to bond the metal strip resistor to a metal heat sink without electrically short circuiting the two yet thermally coupling them together. One solution would be to bond the metal strip resistor element to a substrate then bond the substrate's opposite side to the metal heat sink tab. While this would work it would not efficiently transfer heat energy from the resistor element to the metal heat sink tab. Therefore overcoming the lack of a substrate in an efficient heat transfer method allows metal strip resistor technology to take advantage of power IC-type packages that facilitate wattages of 20 W to 50 W from a resistive element that alone would be rated between 1 W and 5 W. Having no ceramic also shortens the heat transfer path between the resistive element and the heat sink tab lowering the element operating temperature. Overcoming this challenge provides the performance advantages of metal strip resistor technology versus film-type resistors in a high power package. Specific advantages are lower ohmic values, improved pulse power handling, improved TCR and improved Load Life stability.

Figure 15:
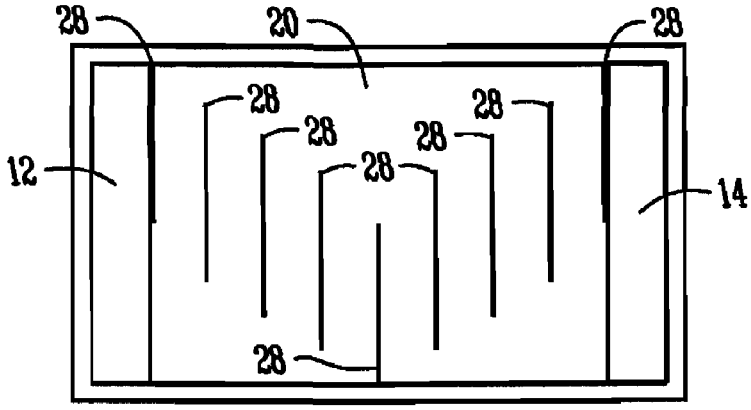
FIG. 15 is a top view showing a resistive element with one embodiment of a trimming pattern to direct current flow and increase the number of hot spots.
Figure 16:
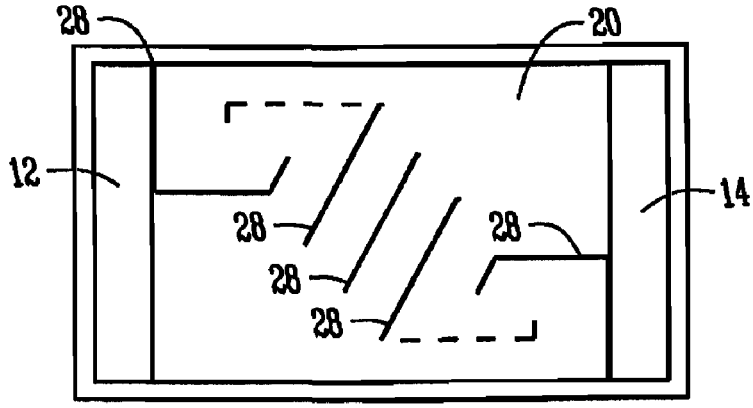
FIG. 16 is a top view showing a resistive element with another trimming pattern to direct current flow and increase the number of hot spots.
Figure 17:
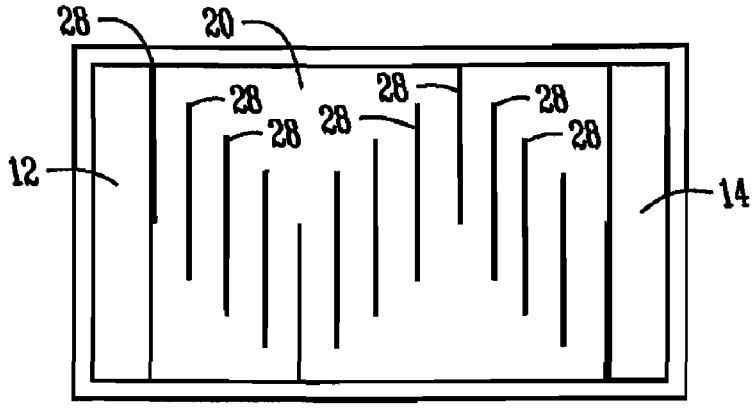
FIG. 17 is a top view showing a resistive element with another trimming pattern to direct current flow and increase the number of hot spots.

As previously discussed, the present invention provides for the routing of current into areas of the resistor normally underutilized. An additional consideration is doing so is trim or trimming pattern used to direct current flow. FIGS. 1-5 and 7-8 illustrate a serpentine current path formed by slots extending inwardly from an edge of the resistive element. However, such a trimming pattern is merely representative and illustrated as such for convenience. Another aspect of the present invention provides for trimming patterns such as those shown in FIG. 15, FIG. 16, and FIG. 17. Note the differences in angles and geometries shown. Such laser trim patterns may be used to avoid current crowding or otherwise control or route current. Note also where the resistive element is segmented, each resistive element segment may have its own trimming pattern, independent from any trimming pattern of other resistive element segments.

Figure 18:
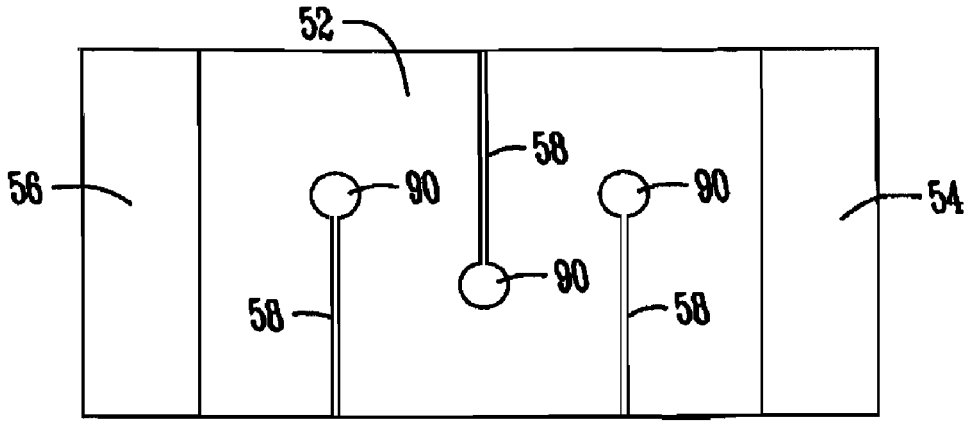
FIG. 18 is a top view showing a resistive element with another trimming pattern where slots terminate in holes to spread the localized hot spot.
Figure 19:
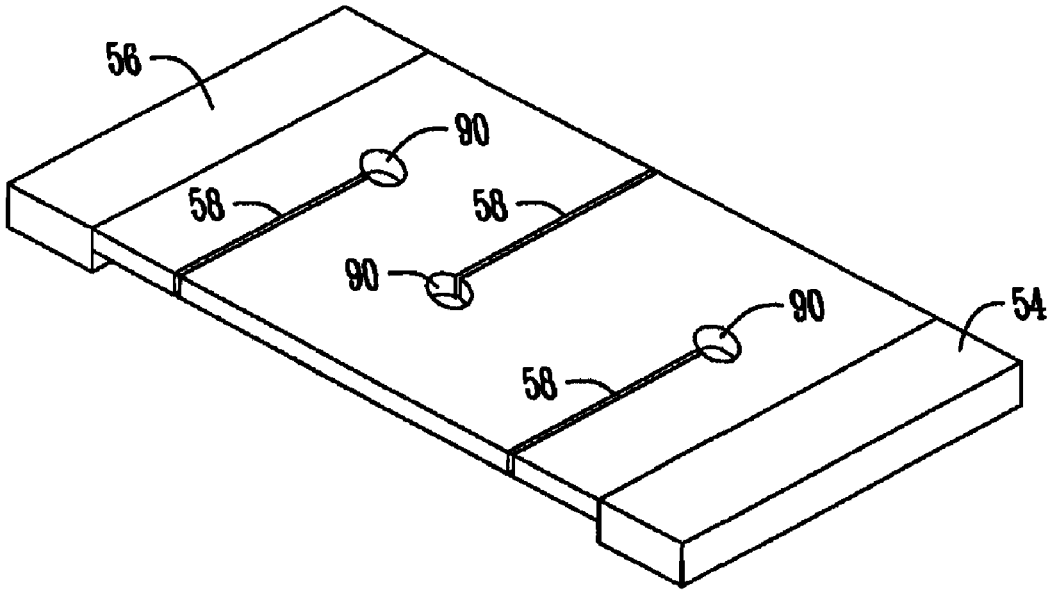
FIG. 19 is a perspective view of the resistive element shown in FIG. 18.

According to another aspect of the present invention, FIGS. 18 and 19 illustrate a resistive element 52 with another trimming pattern where slots 58 terminate in holes 90 to spread the localized hot spots. The holes 90 may be of any shape without sharp corners in the current path. Although not wishing to be bound to a theory of operation, it is believed that this structure spreads heat over a wider area, thus may be used to assist in minimizing hot spot temperatures and minimizing temperature differential between hot and cold areas of the resistive element. Thus, current can be manipulated in this fashion as well.

It should be appreciated that the present invention contemplates numerous variations and alternatives, including those described herein.

What is claimed is:

1. A resistor, comprising:

a resistive element;

a heat sink tab bonded to the resistive element with a thermally conductive and electrically insulative material to mechanically connect the heat sink tab and the resistive element without electrically connecting the heat sink tab to the resistive element, wherein the resistive element comprises a plurality of resistive element segments between the first and second terminations;

a molded body encasing the resistive element; and first and second terminations electrically connected to the resistive element and extending from the molded body.

2. The resistor of claim 1, wherein the resistive element is a metal strip resistive element.

3. A resistor, comprising:

a resistive element;

a heat sink tab bonded to the resistive element with a thermally conductive and electrically insulative material to mechanically connect the heat sink tab and the resistive element without electrically connecting the heat sink tab to the resistive element;

a molded body encasing the resistive element; and first and second terminations electrically connected to the resistive element and extending from the molded body, wherein the resistive element is formed from a plurality of resistive element segments between the first and second terminations and at least one segmenting conductive strip separating two of the resistive element segments.

4. A resistor, comprising:

a resistive element;

a heat sink tab bonded to the resistive element with a thermally conductive and electrically insulative material to mechanically connect the heat sink tab and the resistive element without electrically connecting the heat sink tab to the resistive element;

a molded body encasing the resistive element; and first and second terminations electrically connected to the resistive element and extending from the molded body, and further comprising at least one open area between the first and second opposite terminations and separating at least two resistive element segments, wherein separation of the plurality of resistive element segments assists in spreading heat throughout the power resistor.

5. The resistor of claim 1 wherein the first termination is formed from a first outer metal strip, the resistive element is formed from a middle strip, and the second opposite termination is from a second opposite outer metal strip, the three strips being joined together.

6. The resistor of claim 5 wherein the middle strip comprises a resistive material clad with a conductive material, with a portion of the conductive material etched away.

7. The resistor of claim 1 wherein the first and second terminations are folded under the resistive element.

8. A method of manufacturing a resistor, comprising:

providing a resistive element;

bonding the a resistive element to a heat sink tab with a thermally conductive and electrically insulative material to mechanically connect the heat sink tab and the resistive element without short circuiting the heat sink tab to the resistive element, wherein the resistive element comprises a plurality of resistive element segments between the first and second terminations;

connecting first and second terminations to the a resistive element; and encasing the a resistive element within a molded body.

9. A method of manufacturing a resistor, comprising:

providing a resistive element;

bonding the a resistive element to a heat sink tab with a thermally conductive and electrically insulative material to mechanically connect the heat sink tab and the resistive element without short circuiting the heat sink tab to the resistive element;

connecting first and second terminations to the a resistive element; and encasing the a resistive element within a molded body, wherein the resistive element is formed with a plurality of resistive element segments between the first and second terminations and at least one segmenting conductive strip separating two of the resistive element segments.

10. A method of manufacturing a resistor, comprising:

providing a resistive element; bonding the a resistive element to a heat sink tab with a thermally conductive and electrically insulative material to mechanically connect the heat sink tab and the resistive element without short circuiting the heat sink tab to the resistive element;

connecting first and second terminations to the a resistive element; and encasing the a resistive element within a molded body, and further comprising forming at least one open area between the first and second opposite terminations and separating at least two resistive element segments, wherein separation of the plurality of resistive element segments assists in spreading heat throughout the power resistor.

11. The method of claim 8, wherein the first termination is formed from a first outer metal strip, the resistive element is formed from a middle strip, and the second opposite termination is from a second opposite outer metal strip, the three strips being joined together.

12. The method of claim 11, wherein the middle strip comprises a resistive material clad with a conductive material, with a portion of the conductive material etched away.

13. The method of claim 8, wherein the first and second terminations are folded under the resistive element.

* * * * *